US012281476B2

(12) United States Patent
Imfeld

(10) Patent No.: US 12,281,476 B2
(45) Date of Patent: Apr. 22, 2025

(54) SHADING DEVICE

(71) Applicant: STOBAG AG, Muri (CH)

(72) Inventor: Jost Imfeld, Scherz (CH)

(73) Assignee: Stobag AG, Muri (CH)

( * ) Notice: Subject to any disclaimer, the term of this patent is extended or adjusted under 35 U.S.C. 154(b) by 321 days.

(21) Appl. No.: 17/764,102

(22) PCT Filed: Sep. 24, 2020

(86) PCT No.: PCT/EP2020/076703
§ 371 (c)(1),
(2) Date: Mar. 25, 2022

(87) PCT Pub. No.: WO2021/058642
PCT Pub. Date: Apr. 1, 2021

(65) Prior Publication Data

US 2022/0356710 A1 Nov. 10, 2022

(30) Foreign Application Priority Data

Sep. 27, 2019 (DE) ..... 10 2019 006 789.4

(51) Int. Cl.
*E04F 10/06* (2006.01)

(52) U.S. Cl.
CPC ..... *E04F 10/0607* (2013.01); *E04F 10/0692* (2013.01); *E04F 10/0648* (2013.01)

(58) Field of Classification Search
CPC ..... E04F 10/0607; E04F 10/0692; E04F 10/0648; E04F 10/0655; E05F 1/16; E05F 3/22; E05F 3/221; E05F 3/226
See application file for complete search history.

(56) References Cited

U.S. PATENT DOCUMENTS 2,277,316 A * 3/1942 Garrison ..... E05F 1/1008 16/49
2,541,720 A * 2/1951 Robinson ..... E05C 19/04 292/75

(Continued)

FOREIGN PATENT DOCUMENTS

EP 1 223 262 A1 7/2002
EP 2 441 913 A1 4/2012

(Continued)

OTHER PUBLICATIONS

Machine translation; ITUB20156296; Barbieri, Lucio; 2017 (Year: 2017).*

*Primary Examiner* — Abe Massad
(74) *Attorney, Agent, or Firm* — Muncy, Geissler, Olds & Lowe, P.C.

(57) ABSTRACT

The invention relates to a shading device comprising a cloth that can be spread out in a cloth plane and is connected to a lead bar that is slidably guided in guides. The guides run horizontally or at a slight inclination to a horizontal. A blocking device has a displaceable stop part which can be displaced between a stop position, in which it can be brought into contact with the lead bar, and a release position. The blocking device is arranged below the cloth plane and below the lead bar and has a displaceably mounted switching part which can be displaced by means of the lead bar, the switching movement of which switching part can be conveyed to the stop part by means of a transmission device in order to adjust said stop part between the stop position and the release position.

15 Claims, 9 Drawing Sheets

(56) References Cited

U.S. PATENT DOCUMENTS

| | | | | | |
|---|---|---|---|---|---|
| 4,506,407 | A * | 3/1985 | Downey | E05C 17/28 | 16/49 |
| 4,984,331 | A * | 1/1991 | Hucknall | E05C 17/30 | 16/323 |
| 5,794,679 | A * | 8/1998 | Williams | E06B 9/262 | 160/46 |
| 6,006,809 | A * | 12/1999 | Williams | E06B 9/262 | 160/46 |
| 11,619,087 | B2 * | 4/2023 | Seppänen | E05F 3/222 | 16/49 |

FOREIGN PATENT DOCUMENTS

| | | | |
|---|---|---|---|
| EP | 2 722 460 | A1 | 4/2014 |
| EP | 3 181 800 | A1 | 6/2017 |
| EP | 3 517 702 | A1 | 7/2019 |
| GR | 20100100445 | A | 3/2012 |
| IT | UB20156296 | A1 * | 6/2017 |

* cited by examiner

SHADING DEVICE

This nonprovisional application is a National stage of International Application No. PCT/EP2020/076703, which was filed on Sep. 24, 2020, and which claims priority to German Patent Application No. 10 2019 006 789.4, which was filed in Germany on Sep. 27, 2019, and which are both herein incorporated by reference.

BACKGROUND OF THE INVENTION

Field of the Invention

The invention relates to a shading device, comprising a cloth that can be spread out in a cloth plane and is connected to a lead bar, the lead bar being slidably guided in guides, the guides running horizontally or at an inclination of at most 30° to a horizontal, and comprising at least one blocking device that has a displaceable stop part which can be displaced between a stop position, in which it can be brought into contact with the lead bar, and a release position.

Description of the Background Art

A shading device within the meaning of the invention can be, for example, a conservatory shade, a pergola shade, or a so-called horizontal awning. In the following, a conservatory shade is used as an example, but the invention is not restricted to this.

A conservatory of the usual structure has a frame construction, in particular made of metal profiles or wooden beams, with the wall and roof surfaces being partially or preferably completely filled with glass or other surface elements. On the top of the conservatory, a plurality of guide rails are mounted parallel to and at a distance from one another, in which rails a strip-like lead bar can be moved in the longitudinal direction or in the axial direction of the guide rails. The lead bar is connected to a front edge of a cloth that can be wound onto and unwound from a cloth shaft. The lead bar can be moved along the guide rails by means of a drive device, as a result of which the cloth is unwound from the cloth shaft and spread out. To retract the cloth, the cloth shaft is rotated, which winds up and retracts the cloth and slides the lead bar along the guide rails.

Many users want the cloth to be kept under tension rather than sag. For this purpose, it is known to provide manually displaceable stops on the guide rails. When a user has brought the stops into the stop position, the stops impede movement of the lead bar along the guide rails, with the lead bar abutting the stops. If a further retraction movement is applied to the cloth by rotating the cloth shaft, the lead bar cannot follow this movement because it is abutting the stops, and therefore the cloth is kept under tension. However, the manual displacement of corresponding stops is very tedious and inconvenient for the user.

A pergola shade is known from EP 2 722 460 A1 in which the lead bar can be locked in place relative to the guide rails by means of electrically displaceable pawls. A configuration of this kind has a complex and expensive design.

EP 3 181 800 A1 describes a shading device in which a fixed stop is attached to each of the guide rails. The lead bar carries a spring-loaded contact pin, which avoids the stop when the lead bar is extended and then engages behind it so that the cloth can be tensioned. In order to retract the cloth and the lead bar, the lead bar is initially extended further until the stop pin engages behind a pivotably mounted ramp element, which rests against the stop when the lead bar is retracted, forming a ramp surface, so that the spring-loaded stop pin avoids the stop and the lead bar can be retracted. The disadvantage of this configuration is that the stop is permanently in the movement path of the lead bar and movable and displaceable parts must be provided both on the lead bar and on the guide rails in order to be able to avoid the stop, making the design complex.

All of the designs from the prior art mentioned have in common that the blocking device is fixedly integrated into the interior of the guide rails and that the lead bar engages with the blocking device at its axial end faces. This has the disadvantage that the relative position between the guides and the lead bar is predetermined in terms of design and there are few opportunities for spatial and/or design adjustments. In particular, it is not possible for the cloth to protrude laterally beyond the guides or to retract the guides inward relative to the lateral cloth ends.

SUMMARY OF THE INVENTION

The problem addressed by the invention is that of creating a shading device of the type mentioned, which only has freedom of design for the relative position between the lead bar and the guides.

This problem is solved according to the invention by a shading device having the features of claim 1. The blocking device is arranged below the cloth plane and below the lead bar and has a displaceably mounted switching part that can be displaced by means of the lead bar, the displacement movement of which switching part can be conveyed to the stop part by means of a transmission device in order to adjust said stop part between the stop position and the release position.

According to the invention, in a known manner, the displaceable stop part can be displaced between the stop position, in which it can be brought into contact with the lead bar, and the release position. The displacement of the stop part between the stop position and the release position is brought about by the lead bar. When extended, the lead bar comes into contact with the displaceably mounted switching part and exerts a force on the switching part, as a result of which the switching part is displaced. This displacement movement of the switching part is conveyed to the stop part by means of a transmission device, which can be a lever, a rocker, a rod assembly, or some other gear mechanism, as a result of which the stop part is displaced.

Since, according to the invention, the blocking device is arranged below the cloth plane and below the lead bar, or the lead bar, during its extension movement, is moved over the blocking device, the blocking device can preferably be arranged on the inner side of the guides or even attached to a separate holding structure, as long as the lead bar moves over the blocking device during its extension movement. In particular, due to the configuration according to the invention, the lead bar can also protrude laterally beyond the associated guide of at least one of its axial ends.

It is preferably provided that the switching part, which can be a pin or a lever, can be brought into contact with a control part formed on the lead bar. For this purpose, the lead bar can carry the preferably block-like control part on which a control cam or control surface is formed. When the lead bar comes into contact with the switching part, it exerts a compressive force on the switching part, thereby displacing the switching part.

The control part and optionally also the control cam or surface are preferably arranged on the underside of the lead bar. Furthermore, the control part can be arranged at a distance from the axial end of the lead bar and, in particular, can be fastened to the underside of the lead bar.

When the lead bar is extended and the cloth is spread out, the lead bar is moved in an extension direction. The switching part and the stop bar are preferably arranged relative to one another in such a way that the switching part is arranged downstream of the stop part in the extension direction of the lead bar. As a result, the lead bar moves over the stop part first when it is extended, without coming into contact with said stop part. The lead bar then hits the switching part therebehind, comes into contact with said switching part, and displaces said switching part. Due to the displacement of the switching part, the stop part is displaced into its stop position, so that the lead bar, during its opposite retraction movement, comes into contact with the stop part and the cloth is tensioned upon a further rotation of the cloth shaft.

In order to bring the blocking device and the stop part back into the release position, the lead bar is first moved in the extension direction from its position in contact with the stop part until its control part or control cam comes into contact with the switching part and said switching part is displaced again, whereby the stop part is returned to its release position, so that the lead bar, during its subsequent opposite retraction movement, is no longer impeded by the stop part.

The stop part and the switching part are each mounted displaceably. In this case, the switching part can be slidably, preferably linearly slidably, and/or pivotably mounted. The switching part can also be slidably, preferably linearly slidably, and/or pivotably mounted.

The shading device usually has a plurality of guides, which can be parallel linear guides arranged at a distance, for example in the form of straight guide rails. At least one of the guides carries said blocking device. Preferably, a plurality of guides have an aforementioned blocking device and, in particular, each guide has a corresponding blocking device.

In a further development of the invention, one guide, or a plurality of guides, or all guides have or has a plurality of blocking devices arranged at an axial distance in the longitudinal direction of the guide. The plurality of blocking devices can be identical in design and/or have the same functional effect. However, it is also possible to use different blocking devices. The axial distance relates to the longitudinal extent of the guides and thus to the extension movement and retraction movement of the lead bar. In this way, it is possible to keep the lead bar under tension not only in the fully extended state of the cloth, but also in an intermediate state.

In a further development of the invention, the blocking device is designed as an independent modular unit which has a carrier part on which the stop part, the switching part, and the transmission device are mounted. The modular unit is releasably attached to the guide and can be removed therefrom and remounted at another location on the guide. In this way, it is possible for the user to select the position of the blocking device individually and thus determine the position in which the lead bar is fixed relative to the guides and the state in which the cloth is tensioned.

The modular unit preferably also includes a housing in which the stop part, the switching part, and the transmission device are accommodated, so that these components and assemblies are protected from external influences.

The carrier part can optionally be attached in different portions of the guide or guides. A clamping device or a screw device can be provided for this releasable holding of the carrier part and thus of the modular unit on the guide. The carrier part or the modular unit can be fixed in a frictional and/or interlocking manner on the guide.

When moving the lead bar, the lead bar comes into contact with the switching part and displaces it. Frictional forces occur between the lead bar and the switching part. In order to keep these frictional forces low, the switching part can have a rotatably mounted roller which comes into contact with the control cam of the lead bar and rolls on it. Alternatively, the switching part can have a slider, i.e. in particular a component made of a material with a low coefficient of friction.

The switching part is preferably slid linearly, with this movement being conveyed to the stop part via the transmission device and displacing said stop part. A so-called push-push mechanism can be integrated into the switching part, as is known, for example, in the actuation of ballpoint pens. This mechanism ensures that the switching part, after being actuated, returns to its starting position or a position close to the starting position and does not remain in the displaced or slid position. When the switching part is activated, it only returns to its original starting position with every second activation. In the intermediate states, the switching part can be held in a position that deviates slightly from the starting position, this deviating position preferably deviating from the switching position into which the switching part is slid by the lead bar.

The transmission device can be a rocker, a lever, a rod assembly, or any type of gear mechanism, for example a toothed drive with a plurality of toothed wheels, or a belt drive. The transmission device is designed in such a way that an actuation or displacement of the switching part by means of the lead bar results in a displacement of the stop part. When the stop part is in its stop position, it is displaced into its release position as a result of the actuation of the switching part. If the stop part is in its release position, it is brought into its stop position by actuation of the switching part.

In order to ensure that the switching part is in a position in which it can come into contact with the lead bar, the switching part can be prestressed into this position by means of a spring.

In a development of the invention, the stop part can be displaceably mounted in such a way that it can be displaced both by the displacement movement conveyed via the transmission device and manually by the user. If the switching part and/or the transmission device is not functioning properly as a result of a defect, the user can release the stop part from functional engagement with the transmission device and then manually displace the stop part between the stop position and the release position, so that the functionality of the blocking device is retained. This releasing can be irreversible, but it is also possible for the user to later restore the functional engagement between the stop part and the transmission device, i.e. for the release to be reversible.

In a possible embodiment of the invention, the guides can be arranged perpendicular to the lead bar and on the edges of the cloth running perpendicular to the lead bar. Alternatively or additionally, the guides can also run below and/or above the cloth and in particular in the edge regions thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
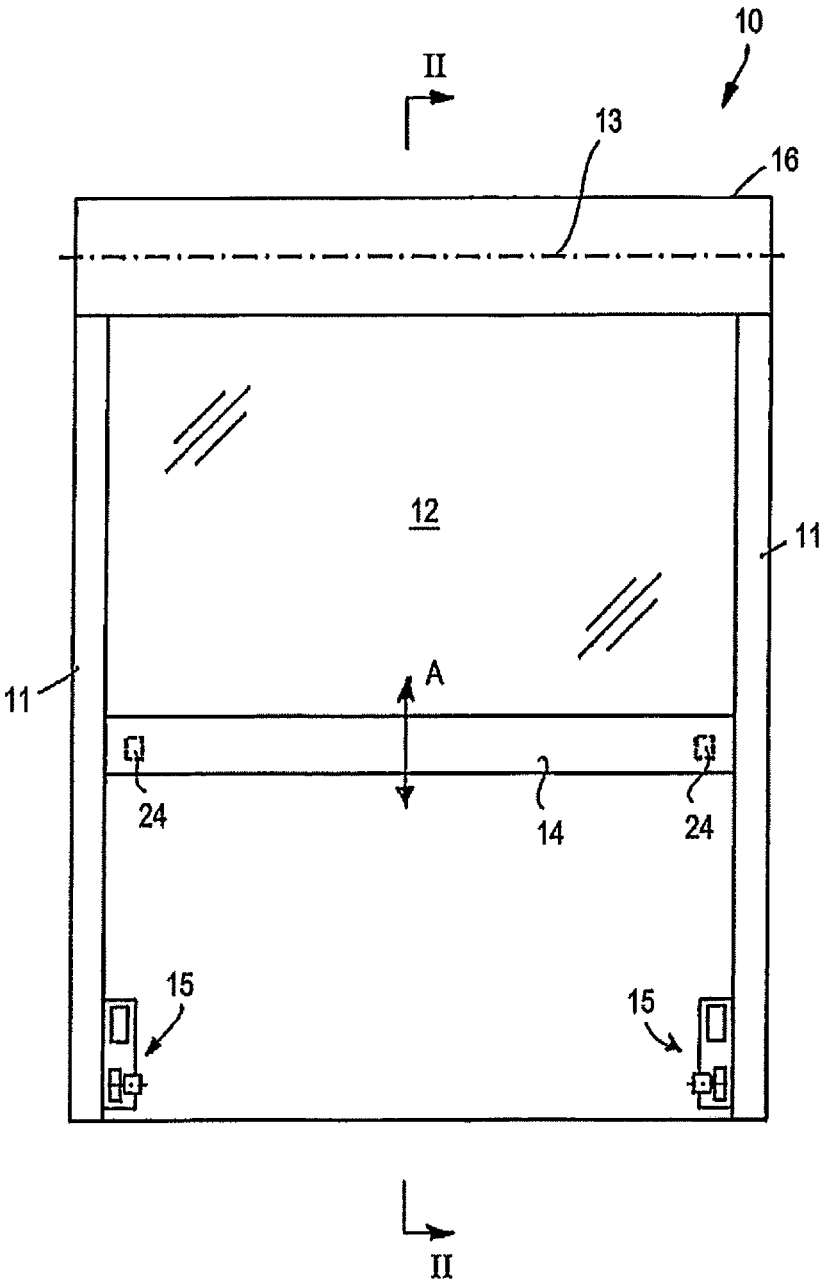
FIG. 1 is a schematic view of a shading device according to the invention.

A shading device 10 shown schematically in FIG. 1 has two guides 11 in the form of straight guide rails which run parallel to one another and are arranged at a mutual distance from one another, between which rails a lead bar 14 is arranged, which bar is guided in the guides 11 at its respective end portions and is displaceable along the guides 11, as indicated by the double arrow A.

At the rear end of the guides 11, which is the upper end according to FIG. 1, a cloth shaft housing 16 is arranged in which a cloth shaft 13 (shown only schematically) is accommodated. A cloth 12 can be wound up on the cloth shaft 13 and unwound from the cloth shaft 13. The front long side of the cloth 12, which is the lower long side according to FIG. 1, is connected to the lead bar 14.

The lead bar 14 can be moved along the guides 11 by means of a drive device (not shown), and in the process moved away from the cloth shaft 13. This is referred to as the extension movement. The extension movement of the lead bar 14 pulls the cloth 12 off the cloth shaft 13 and spreads it out between the cloth shaft 13 and the lead bar 14.

The cloth shaft 13 is assigned a cloth shaft motor (not shown) by means of which the cloth shaft 13 can be rotated so that the cloth 12 is wound up on the cloth shaft 13 and the lead bar 14 is retracted along the guides 11 toward the cloth shaft 13.

Figure 2:
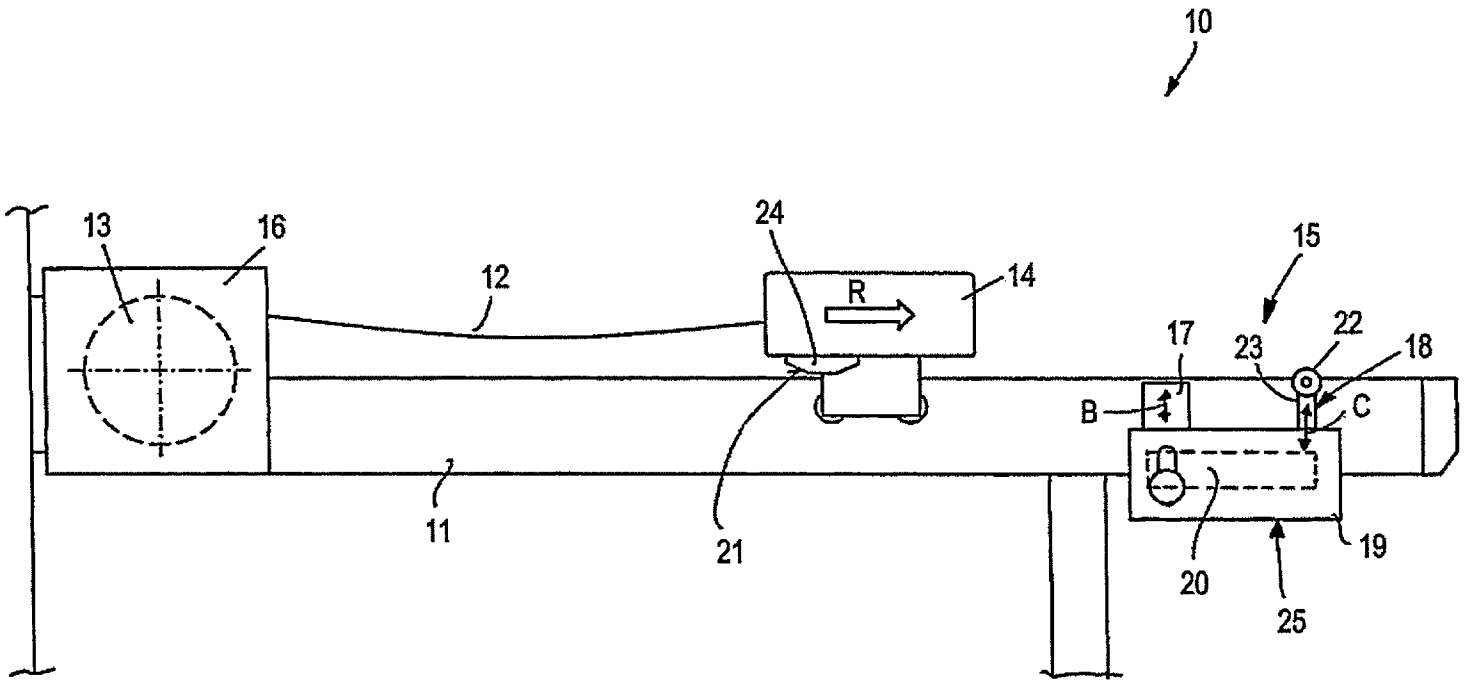
FIG. 2 is the section II-II from FIG. 1.

Near the outer end of the guides 11 that faces away from the cloth shaft housing 16, a blocking device 15, which is shown in particular in FIG. 2, is attached to said guides on their mutually facing inner sides. The blocking devices 15 are arranged below the cloth 12 and the lead bar 14 can move over them.

The blocking device 15 comprises a housing-like carrier part 19 which is releasably attached to the guide 11 and can be positioned on the guide 11 in various positions. A stop part 17 is arranged on the carrier part 19 and can be displaced between a stop position, in which it protrudes into the movement path of the lead bar 14, and a release position, as indicated by the double arrow B. In the release position, the lead bar 14 can move over the stop part 17 without coming into contact with it.

A displaceable switching part 18 is arranged on the carrier part 19 on the side of the stop part 17 that faces away from the cloth shaft 13. In the embodiment shown, the switching part 18 is designed as a linearly displaceable pin 23 which has a rotatably mounted roller 22 at its upper end, which upper end faces the movement path of the lead bar 14. The switching part 18 has a push-push mechanism, i.e. after the switching part 18 has been displaced by coming into contact with the lead profile 4 and a switching process has been triggered, the switching part 18 returns completely or at least approximately to its starting position, as indicated by the double arrow C.

A transmission device 20 (shown only schematically), for example in the form of a gear mechanism, is arranged inside the housing-like carrier part 19. A displacement movement of the switching part 18 is converted into a linear displacement movement of the stop part 17 by means of the transmission device 20.

The lead bar 14 has a control part 24 on its underside, which part carries a control cam 21.

Figure 3A:
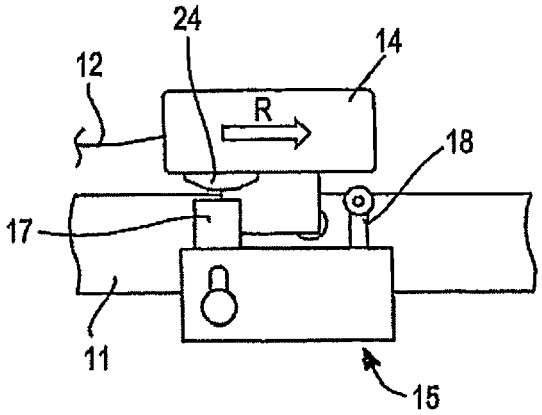
FIGS. 3*a* and 3*b* show the activation of the blocking device when extending the lead bar.

The activation of the blocking device 15 is explained below with reference to FIGS. 2, 3*a*, and 3*b*. The lead bar 14 is extended along the guides 11 by means of a drive device (not shown), as indicated by the arrow R in FIG. 2. The cloth 12 is pulled off the cloth shaft 13 and spread out. As the lead bar 14 moves further, it comes into the region of the blocking device 15. Since the stop part 17 is in its retracted release position, the lead bar 14 can move over the stop part 17 without coming into contact with it. This state is shown in FIG. 3*a*.

During the further extension movement of the lead bar 14, the control part 24 thereof comes into contact with the roller 22 of the switching part 18 and pushes the switching part 18 downwards. The movement of the switching part 18 is conveyed to the stop part 17 via the transmission device 20, so that the stop part 17 is displaced into its stop position, as indicated by the arrow D in FIG. 3*b*. In the stop position, the stop part 17 protrudes into the travel path of the lead bar 14.

Figure 3B:
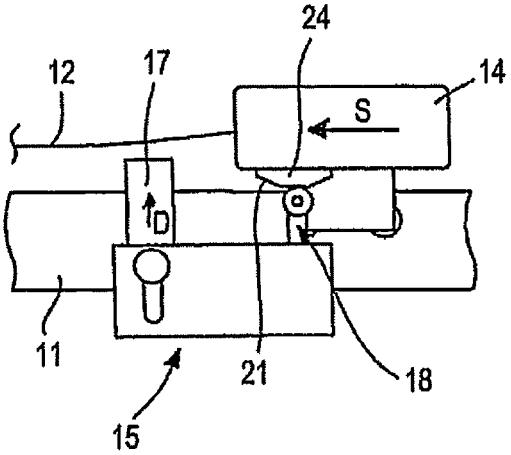

The direction of movement of the lead bar 14 is then reversed, as indicated by the arrow S in FIG. 3*b*. The lead bar 14 abuts the stop part 17 so that further movement of the lead bar 14 in the direction of the cloth shaft 13 is prevented. By activating the cloth shaft 13, the cloth 12 is now tensioned and can be kept under this tension. This state is shown in FIG. 4.

By reversing the direction of movement of the lead bar 14, the control part 24 thereof is released from the switching part 18 of the blocking device 15, so that the switching part 18 returns to its starting position as a result of a spring (not shown).

Figure 4:
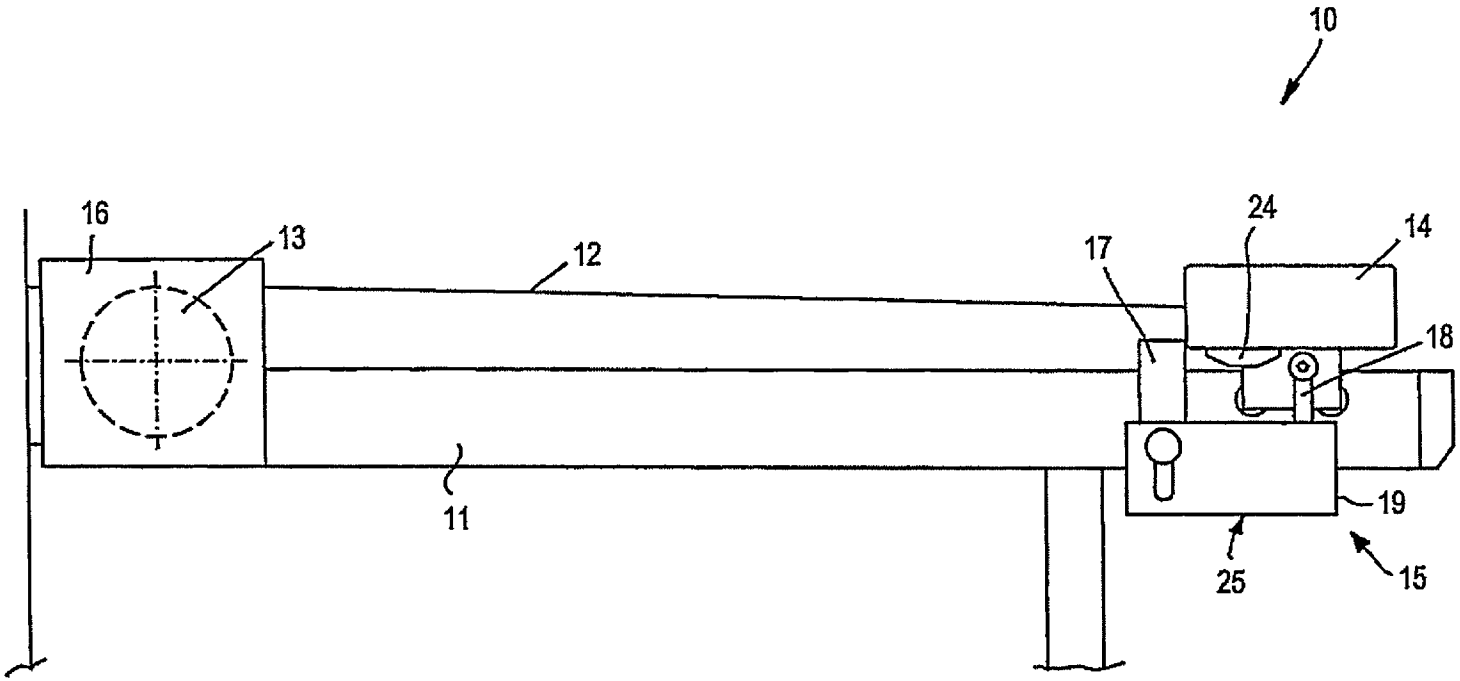
FIG. 4 shows a representation corresponding to FIG. 2, with the lead bar abutting the stop part.
Figure 5A:
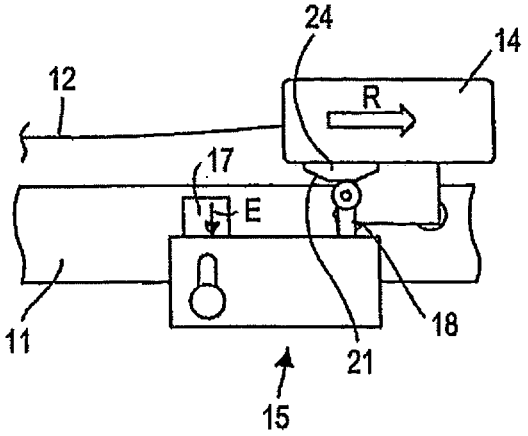
FIGS. 5*a* and 5*b* show the individual phases of the deactivation of the blocking device.
Figure 5B:
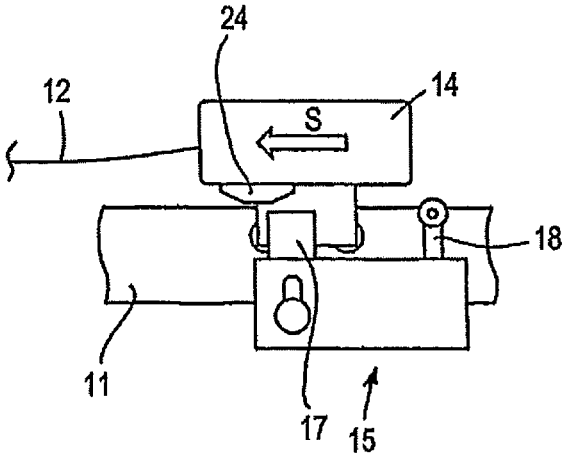

FIG. 4 shows the lead bar 14 in contact with the stop part 17 of the blocking device 15, the cloth 12 being held under tension. In order to retract the shading device from this position, i.e. to wind the cloth 12 back onto the cloth shaft 13, the blocking device 15 must be deactivated. For this purpose, the lead bar 14 is first moved in the extension direction, i.e. moved away from the cloth shaft 13 and the stop part 17, as indicated by the arrow R in FIG. 5*a*. The lead bar 14 is displaced in this was until the control part 24 thereof comes into contact with the switching part 18 and displaces it, as a result of which the stop part 17 is displaced from its stop position into the release position, as indicated by the arrow E in FIG. 5*a*. Since the stop part 17 no longer impedes the movement of the lead bar 14, the lead bar 14 can be retracted in the direction of the cloth shaft 13 (arrow S), passing the stop part 17 without coming into contact with it, as is shown in FIG. 5*b*.

Figure 6:
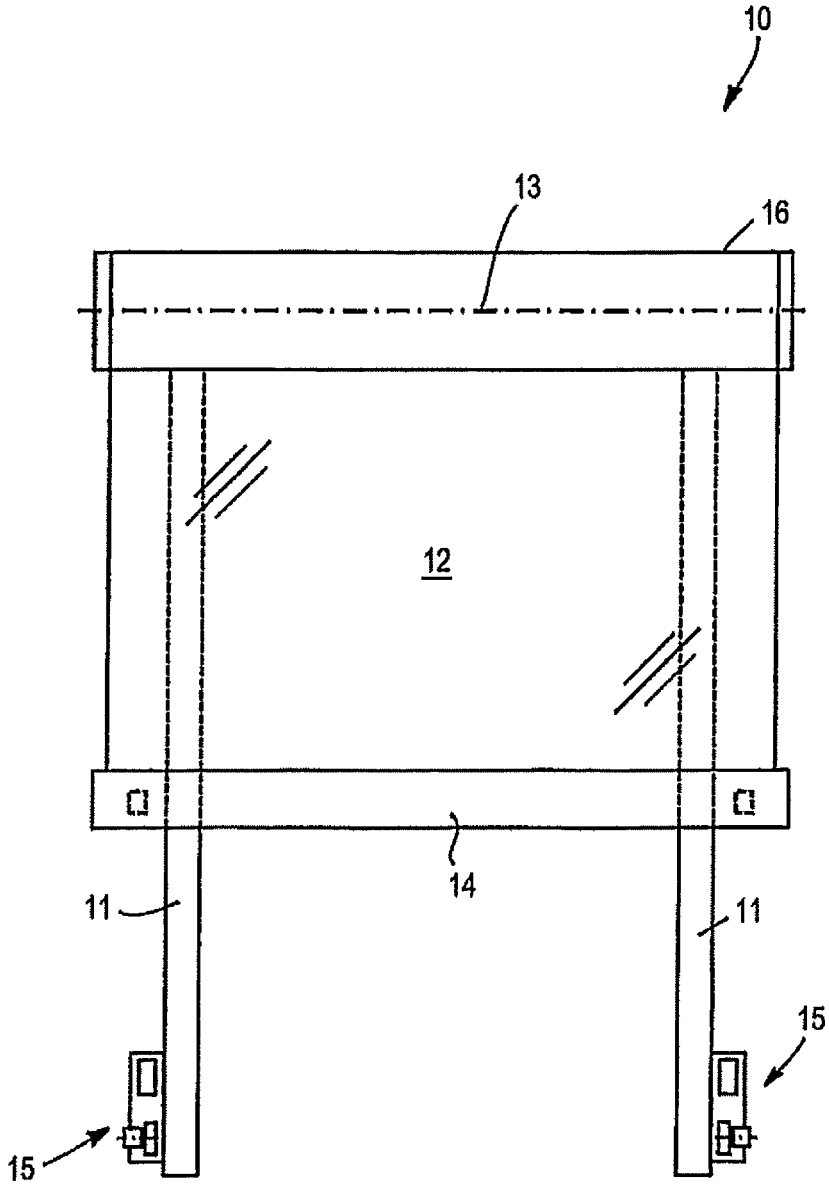
FIG. 6 shows a view corresponding to FIG. 1 of a shading device according to a first modification.

FIG. 6 shows an alternative embodiment to the shading device according to FIG. 1. According to FIG. 1, the shading device 10 has two rail-like guides 11 which guide opposite end portions of the lead bar 14 so that the cloth 12 extends between the guides 11. The embodiment according to FIG. 6 differs from this in that the guides 11 are now also arranged underneath the cloth 12, so that the cloth 12 also covers the tops of the guides when said cloth is pulled out. Alternatively, the cloth 12 can also be arranged below the guides 11.

Figure 7:
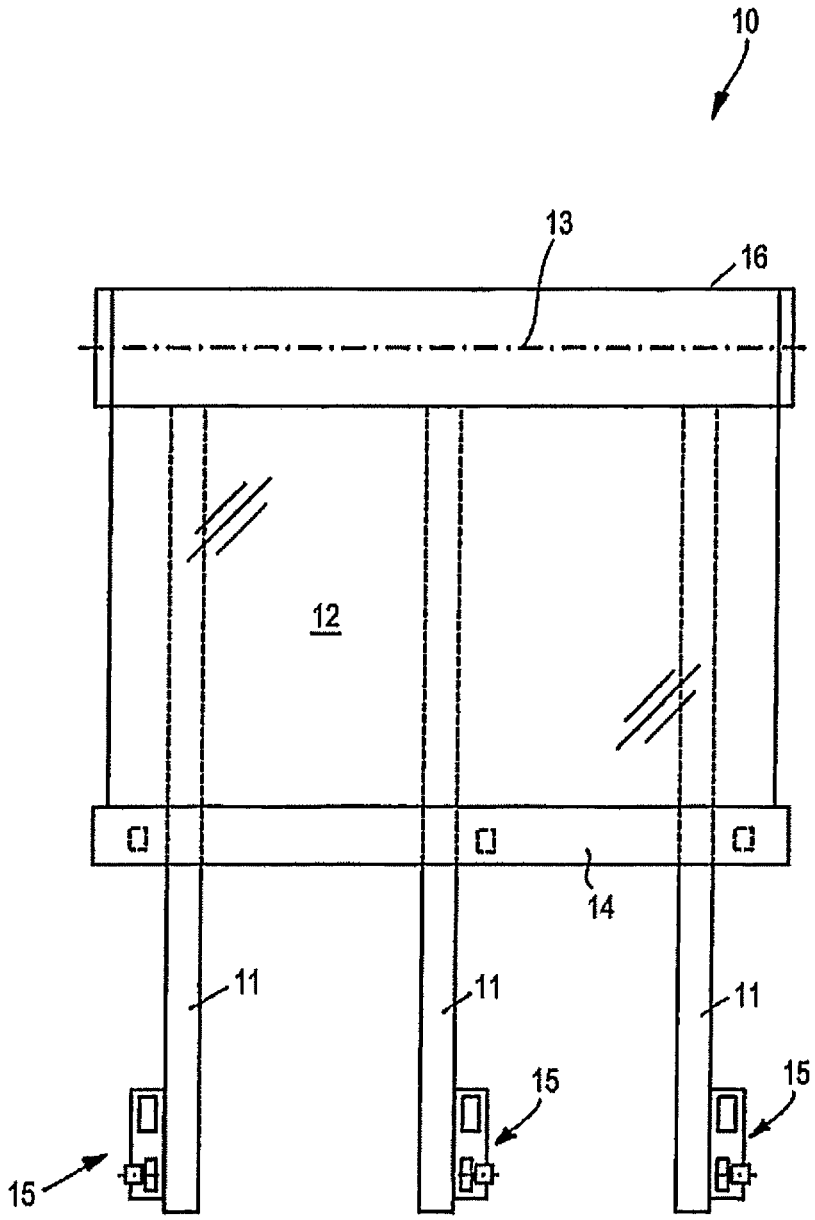
FIG. 7 shows a view corresponding to FIG. 1 of a shading device according to a second modification.

In the embodiment according to FIG. 7, a third rail-like guide 11 is provided, with all guides being at a distance from and running parallel to one another.

Figure 8:
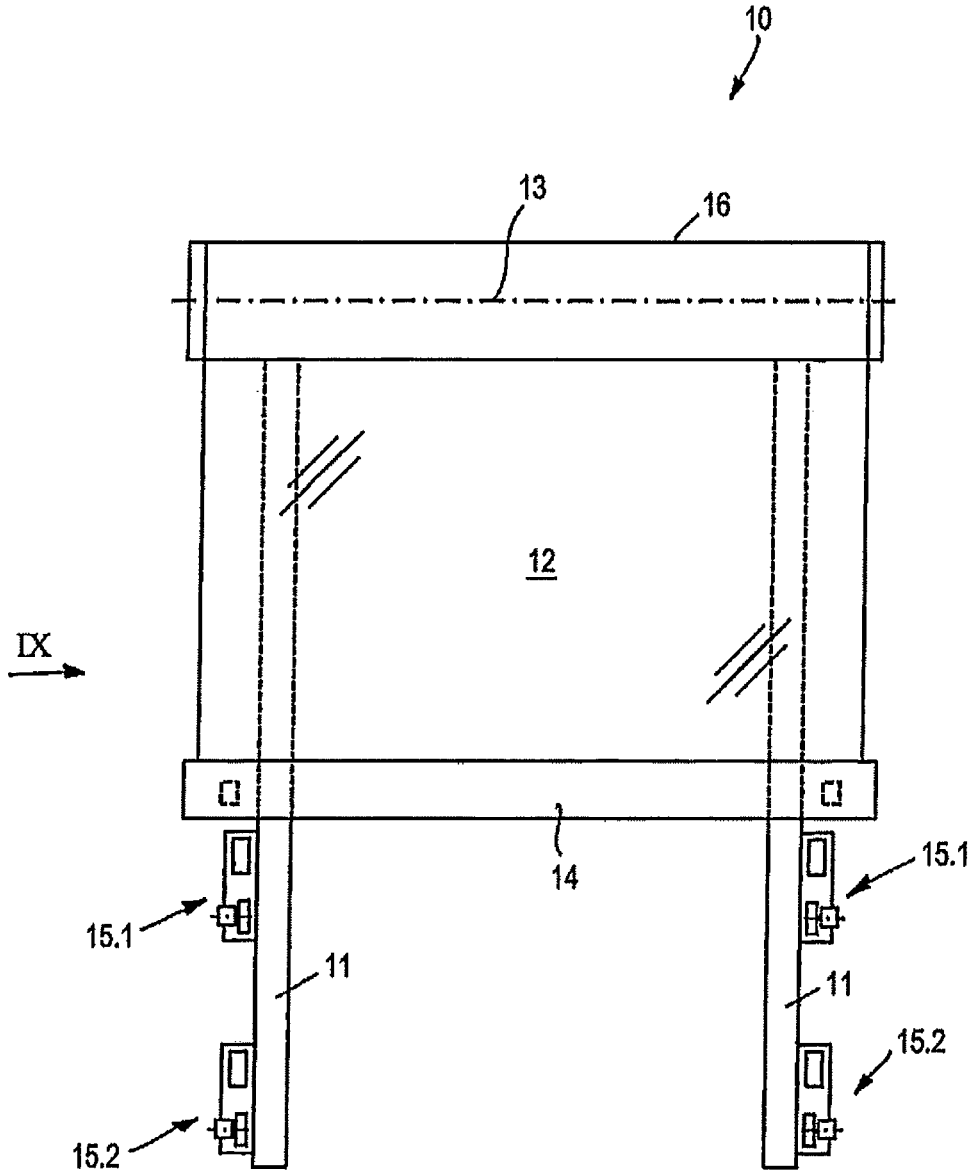
FIG. 8 shows a view corresponding to FIG. 1 of a shading device according to a third modification.
Figure 9:
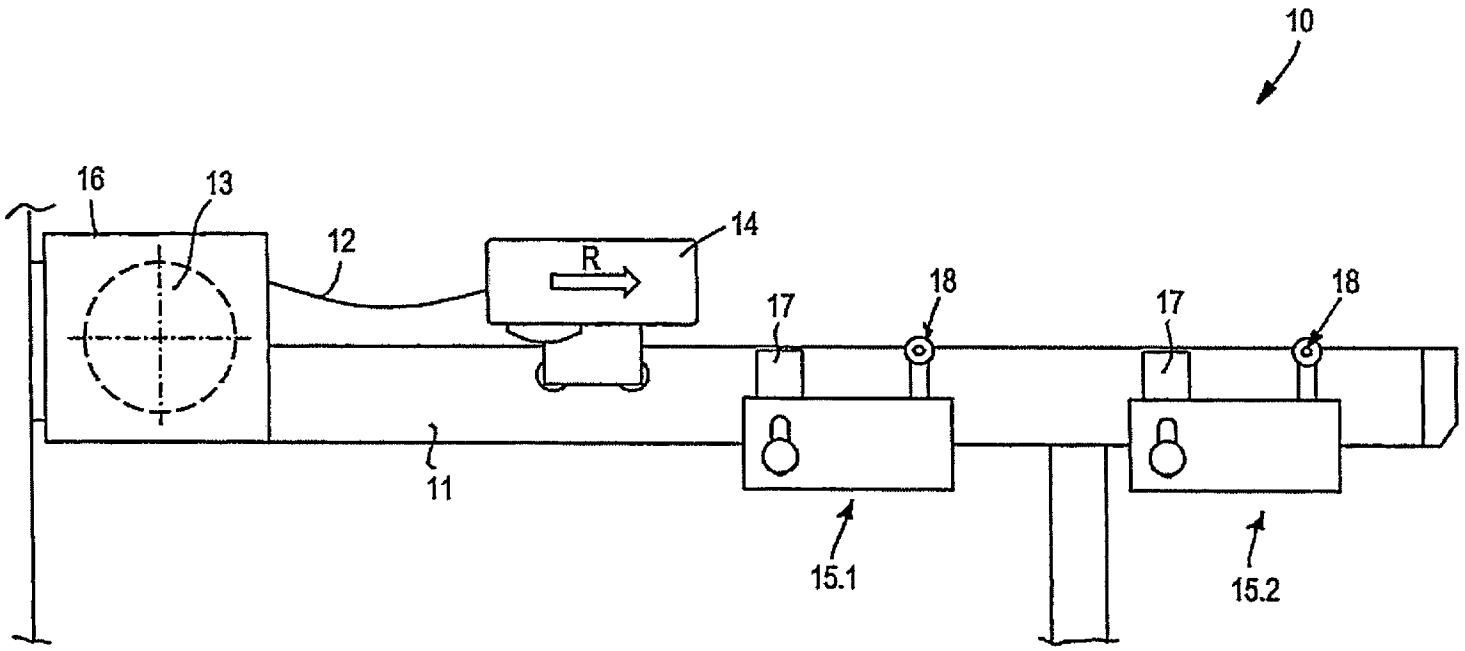
FIG. 9 shows the side view IX in FIG. 8.

In the previous embodiments of the shading device 10, each guide 11 was assigned exactly one blocking device 15. FIGS. 8 and 9 show a further embodiment in which each guide 11 is assigned two blocking devices 15.1 and 15.2, which blocking devices are attached to the respective guides 11 at an axial distance. The blocking devices 15.1 and 15.2 are each structurally and/or functionally identical and have the structure mentioned above. When the lead bar 14 is extended (arrow R in FIG. 9), it runs onto the first blocking device 15.1, as a result of which the stop part 17 is brought from the release position into the contact position in the aforementioned manner. If the user wants to tension the cloth in this position, he can retract the lead bar 14 again in the aforementioned manner and bring it into contact with the stop part 17.

Alternatively, it is also possible for the user to extend the lead bar 14 further until it runs onto the second blocking device 15.2 and brings the stop part 17 thereof into the stop position in the aforementioned manner. When the lead bar 14 is subsequently retracted, said lead bar then abuts the stop part 17.

In order to deactivate the blocking device 15.1 or 15.2, the lead bar 14 is first moved in the extension direction in the aforementioned manner, so that the stop part 17 of the second blocking device 15.2 returns to its release position so that the lead bar 14 can be retracted. If the lead bar 14 then moves onto the first blocking device 15.1, the switching part 18 thereof is actuated, whereby the stop part 17 of the first blocking device 15.1 reaches the release position, so that the lead bar 14 can be further retracted.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A shading device, comprising:

guides that run horizontally or at an inclination of at most 30° to a horizontal;

a lead bar that is slidably guided in the guides;

a cloth that can be spread out in a cloth plane and is connected to the lead bar; and at least one blocking device attached to the guides, the at least one blocking device having a displaceable stop part, a displaceably mounted switching part and a transmission device, wherein the stop part is displaceable between a stop position, in which the stop part is brought into contact with the lead bar, and a release position, wherein the at least one blocking device is arranged below the cloth plane and below the lead bar, wherein the switching part is displaced a displacement movement when contacted by the lead bar, wherein the transmission device is connected between the switching part and the stop part, such that when the displacement movement of the switching part acts on the transmission device, the transmission device displaces the stop part between the stop position and the release position, and wherein prior to being contacted by the lead bar, the switching part is in a starting position and while the stop part is in the stop position, the switching part is in the starting position.

2. The shading device according to claim 1, wherein the switching part is displaced the displacement movement when the switching part is brought into contact with a control part formed on the lead bar.

3. The shading device according to claim 2, wherein the control part is arranged on an underside of the lead bar.

4. The shading device according to claim 2, wherein the control part has a control cam.

5. The shading device according to claim 2, wherein the control part is arranged at a distance from an axial end of the lead bar.

6. The shading device according to claim 1, wherein the switching part is arranged downstream of the stop part in an extension direction of the lead bar.

7. The shading device according to claim 1, wherein the stop part is mounted so as to be slidable or pivotable.

8. The shading device according to claim 1, wherein the switching part is mounted so as to be slidable or pivotable.

9. The shading device according to claim 1, wherein each of the guides has the at least one blocking device attached thereto.

10. The shading device according to claim 1, wherein each of the guides has a plurality of the at least one blocking device attached thereto, the plurality of the at least one blocking device being arranged at an axial distance from one another.

11. The shading device according to claim 1, wherein the stop part, the switching part, and the transmission device are mounted on a carrier part and are removable from the respective guides together with the carrier part as a modular unit.

12. The shading device according to claim 11, wherein the carrier part is selectively attachable to different portions of the guide.

13. The shading device according to claim 4, wherein the switching part has a rotatably mounted roller which is brought into contact with the control cam of the lead bar.

14. The shading device according to claim 1, wherein the switching part is prestressed by a spring.

15. The shading device according to claim 1, wherein the stop part is also manually displaceable between the stop position and the release position.

* * * * *